United States Patent [19]

Wolpert, Jr. et al.

[11] Patent Number: 4,781,151

[45] Date of Patent: Nov. 1, 1988

[54] FLAMELESS HEAT SOURCE

[76] Inventors: George H. Wolpert, Jr., 1044 Park Ave.; Kenneth R. Wolpert, 337 Poplar; Kurt W. Wrede, Box 193AA Loop Rd., all of Columbia, Pa. 17512

[21] Appl. No.: 934,205

[22] Filed: Nov. 24, 1986

[51] Int. Cl.[4] ..... F22B 3/06; F24C 9/00

[52] U.S. Cl. ..... 122/26; 237/1 R; 126/247

[58] Field of Search ..... 126/247; 122/26; 237/1 R

[56] References Cited

U.S. PATENT DOCUMENTS

| | | | |
|---|---|---|---|
| 1,366,455 | 1/1925 | Henson . | |
| 1,682,102 | 8/1928 | Allen . | |
| 2,344,075 | 3/1944 | Beldimano . | |
| 2,625,929 | 1/1953 | Love et al. . | |
| 2,683,448 | 7/1954 | Smith . | |
| 3,164,147 | 1/1965 | Love et al. . | |
| 3,198,191 | 8/1965 | Wyszomirski . | |
| 3,273,631 | 9/1966 | Neuman . | |
| 3,333,771 | 7/1967 | Graham . | |
| 3,402,702 | 9/1968 | Love . | |
| 4,004,553 | 1/1977 | Stendstrom . | |
| 4,143,639 | 3/1979 | Frenette . | |
| 4,357,931 | 1/1982 | Wolpert et al. . | |
| 4,419,980 | 12/1983 | Leary et al. | 126/247 |
| 4,454,861 | 6/1984 | Grenier | 122/26 |
| 4,501,231 | 2/1985 | Perkins | 122/26 |
| 4,516,721 | 5/1985 | Laing et al. | 122/26 |

*Primary Examiner*—Henry A. Bennet

*Attorney, Agent, or Firm*—Paul & Paul

[57] ABSTRACT

This invention utilizes a combustionless heat source wherein a vaned rotor having efficiently designed vanes is rotatably supported within a cavity inside a cylindrically-shaped, cast aluminum block. The vaned rotor is rotated by connection to a power source and thereby imparts mechanical energy of motion to a heat transfer fluid encased within the cavity. Frictional forces developed by agitated molecules of the fluid convert the mechanical energy of motion into heat. The heat thus generated moves uniformly throughout the cylindrically-shaped block and heat transfer fluid is circulated through a circumferential passageway contiguous to substantially all of the outer cylindrical surface of the block and absorbs the heat generated inside the cavity. The heated fluid is then conducted to a remote heat transfer station. An electrical control circuit governs the sequencing of heat demand, heat production and heat transfer cycles.

6 Claims, 5 Drawing Sheets

FLAMELESS HEAT SOURCE

BACKGROUND OF THE INVENTION

In the field of heating devices, one type of heat source converts mechanical energy of motion into heat suitable for raising the temperature of a heat transfer fluid. This so-called "flameless" or "combustionless" heat source is inherently safer than those that derive their heat from burning an input material.

One method of employing this combustionless heat source operates according to pump-type principles. U.S. Pat. No. 3,333,771 to Graham is a representative patent showing this type of flameless heat source. The Graham patent discloses an arrangement wherein a heat transfer fluid or heating liquid is drawn through a rotor chamber and heated to a desired level by the rotational motion of a rotor mounted in the chamber. As built, this invention loses some of its mechanical energy to create discharge pressure at the head end or outlet of the rotor chamber.

Some of the disadvantages which characterize pump-type fluid heaters may be overcome by employing the friction generated between moving layers of fluid in lieu of the centrifugal motion of fluid particles to convert the energy of motion into heat. U.S. Pat. No. 4,143,639 to Frenette discloses a heat source wherein inner and outer drums are concentrically mounted to form a sealed, fluid-tight annular chamber between the exterior surface of the inner drum and the interior surface of the outer drum. A liquid captive in the annular chamber is heated via friction in response to relative rotation between the drums. Even though the Frenette invention manages to overcome the disadvantages of the prior art pump-type fluid heat sources, it fails to fully utilize the heat generated by the rotation of the drums. The heated fluid is retained inside the annular chamber and no efficient relationship is established to transfer the heat from the fluid to a position where it may be used.

U.S. Pat. No. 4,357,931, which issued to Wolpert et al on Nov. 9, 1982 disclosed a flameless heat source that used a vaned rotor rotatably supported within a cavity, and has inlet and outlet ports that temporarily block movement of a heat transfer fluid through the cavity. After the heat transfer fluid reaches a predetermined temperature, the rotation of the vaned rotor is stopped and the inlet and outlet ports are unblocked, thereby enabling the conduction of hot heat transfer fluid to a remote heat transfer surface. Although this invention overcomes the above-noted deficiencies of prior art flameless heat sources, it does have a time delay inherently built into it. The colder fluid is sent into the cavity and the inlet and outlet ports are blocked. Then the vaned rotor is moved to get the fluid heated to the appropriate temperature, and then the ports are unblocked to allow the heated fluid to flow to a transfer surface. The steps of blocking and unblocking the ports cause the time delay between when the demand for heat is sent and when the heat arrives.

SUMMARY OF THE INVENTION

An improved flameless heat source is disclosed wherein a specially-designed, vaned rotor is rotatably supported within a cylindrically-shaped block having an annular cavity with heat transfer fluid therein. The block is formed of cast aluminum and has a circumferential heat transfer fluid passageway contiguous to the outer surface of the metal surrounding the annular cavity. An electric motor provides, through appropriate coupling, mechanical motion to the vaned rotor and its movement inside the cavity causes the fluid therein to become hot. As the temperature of the fluid reaches a predetermined level, heat is drawn into the cast aluminum block and heat transfer fluid from a second source of fluid is pumped through the passageway and absorbs heat from the block as it passes thereby. This heated fluid is carried via an insulated pipe to a heat exchanger where the heat radiates outward and is distributed by known means. Appropriate electronic circuits control the timing of the operation of the electric motor and the fluid pump in coordination with thermostats located in the cavity and at a remote location requiring heat, respectively.

OBJECTS OF THE INVENTION

It is an object of the present invention to provide a flameless heat source that generates heat in an efficient and utilitarian manner.

It is a further object of the present invention to provide a flameless heat source of very high efficiency and improved construction that gives novel advantages over such earlier devices.

It is a still further object of the present invention to provide a flameless heat source that can instantly provide sufficient heat to a distribution point.

It is a still further object of the present invention to provide a flameless heat source that uses a heat transfer fluid to transport heat generated inside a sealed cavity to a distribution point remote from said cavity.

These and other objects and advantages of the present invention will be readily apparent to those skilled in the art by reading the following Brief Description of the Drawings, Detailed Description of the Preferred Embodiment and the appended claims.

DETAILED DESCRIPTION OF THE PREFERRED EMBODIMENT

Figure 2:
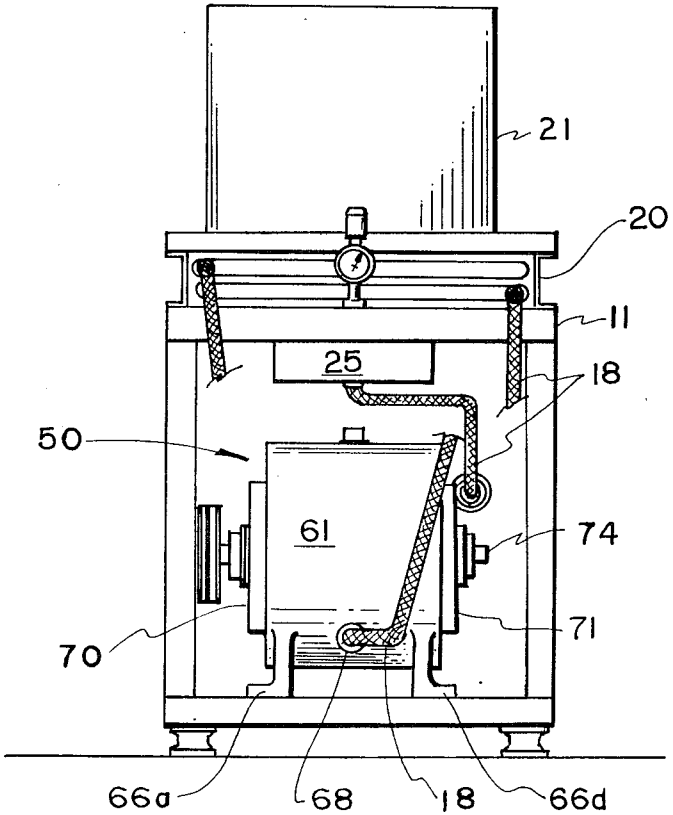
FIG. 2 is an end elevational view of heat source 10.
Figure 1:
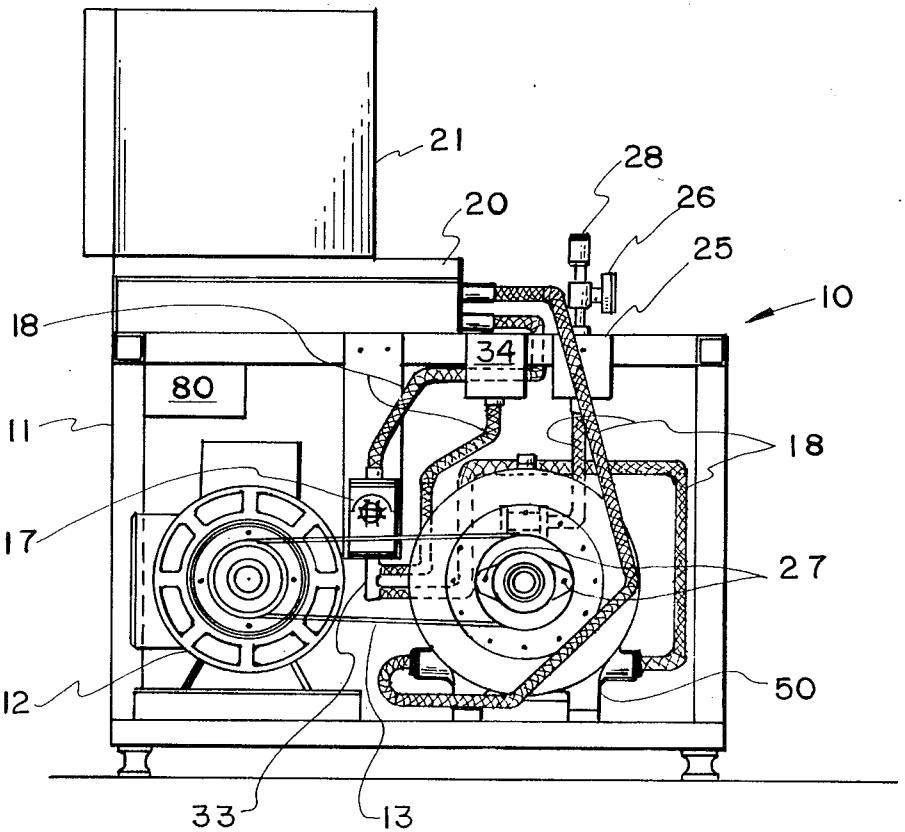
FIG. 1 is a side elevational view of the improved combustionless heat source 10.

A preferred embodiment of the improved flameless heat source 10 is shown in a side elevation view in FIG. 1. The features shown are a housing 11, a power means such as an electric motor 12 connected to a power source that provides 220 VAC, single or triple phase (not shown), electronic control circuitry 80, combustionless heat source block 50, a belt 13 connecting motor 12 to block 50 through appropriate pulleys 89, circulator suction pump 17 connected to the power source, insulated fluid transporting lines 18, heat exchanger 20 and heat distribution means 21. FIG. 2 shows an end elevation view of the system shown in FIG. 1 with fluid transporting lines 18 cut away, as indicated, to show a clearer view of block 50. Housing 11 can be any stainless steel, insulated cabinet type housing, or the like, as found in the HVAC industry, of dimensions sufficient to hold the constituent parts.

Figure 5:
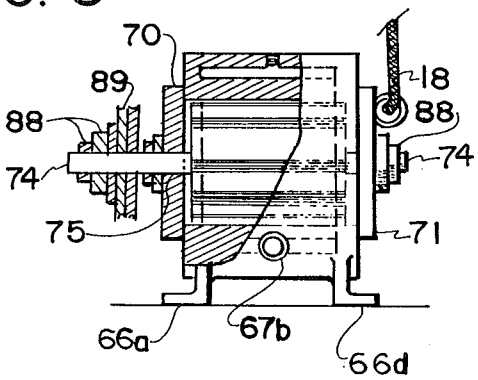
FIG. 5 is a side elevational view of block 50.
Figure 6:
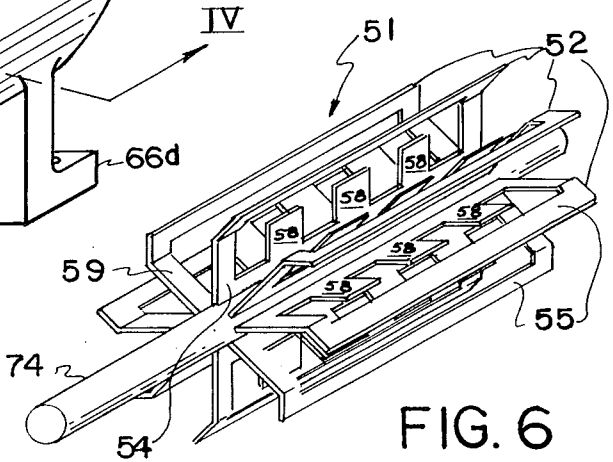
FIG. 6 is an isolated perspective view of rotor 51 removed from block 50 to show construction of vanes 52.
Figure 3:
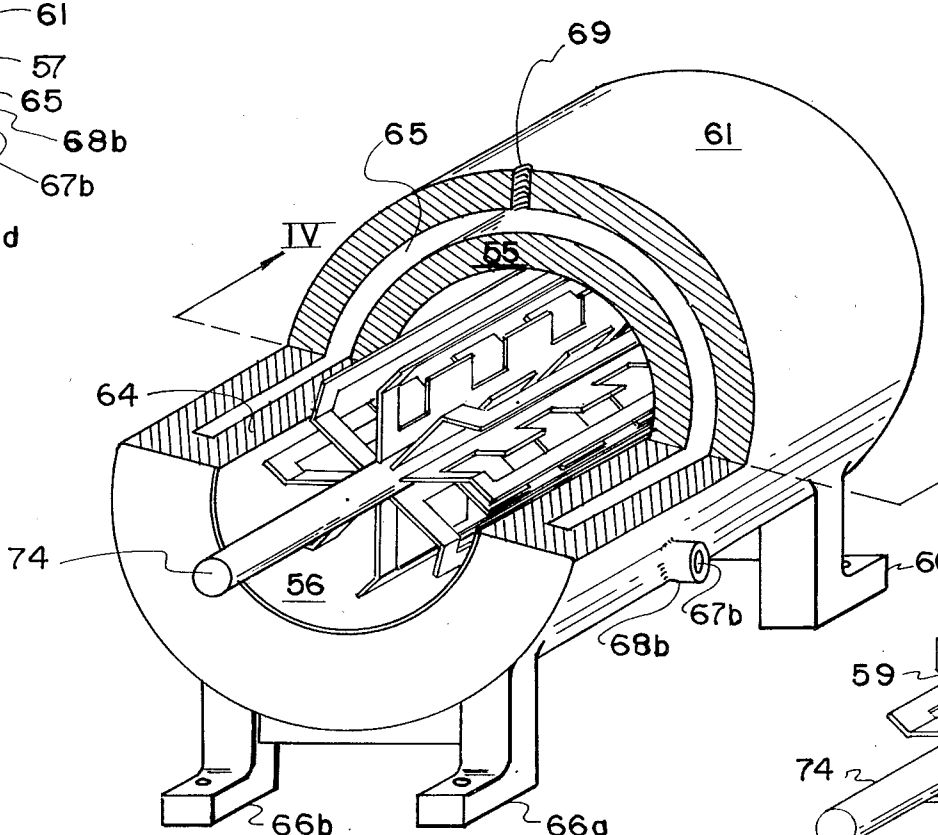
FIG. 3 is an isolated perspective view of block 50 as removed from heat source 10 with the upper quarter of casings 55 and 61 removed to show rotor 51.
Figure 4:
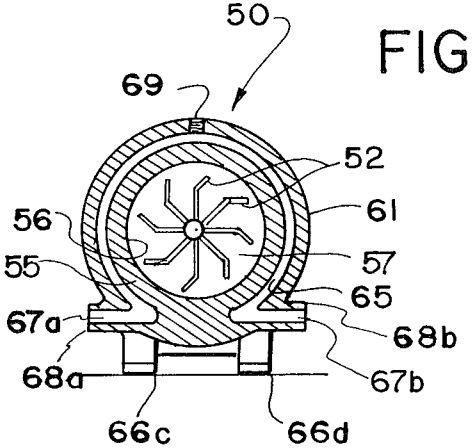
FIG. 4 is a sectional view taken along lines IV—IV on FIG. 3.
Figure 7:
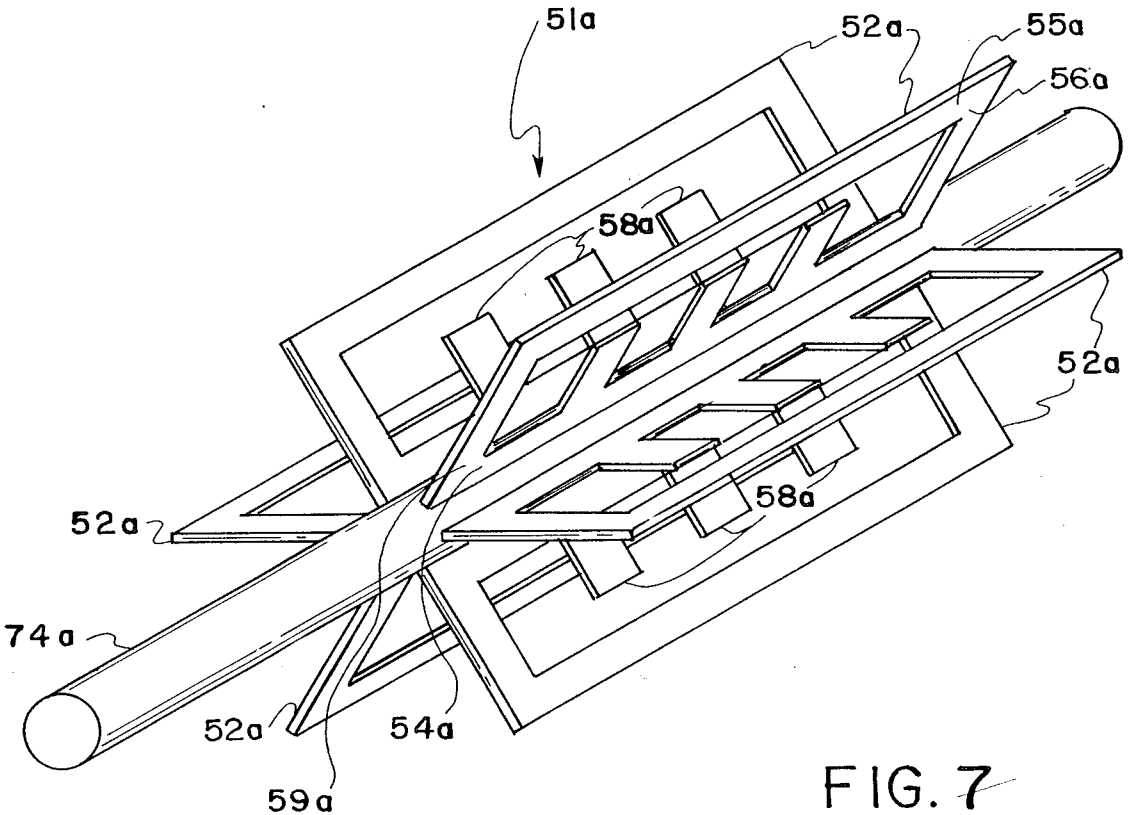
FIG. 7 is an alternate form of the rotor shown in FIG. 6.

FIG. 3 shows a perspective view, with the top quarter cut away, of block 50 and one form of vaned rotor 51. FIGS. 4 and 5 provide a sectional elevation view, taken along lines IV—IV of FIG. 3 and a side elevational view (with partial cutaway) of block 50, respectively. FIG. 6 shows a perspective view of vaned rotor 51 and FIG. 7 shows an alternate view of the vaned rotor.

Block 50 is made of cast aluminum 356-T51 alloy, using the "cold set" method, or other suitable material. An inner cylindrical shell 55 of predetermined thickness surrounds an annular cavity 57 that contain a quantity of fluid $F_1$ and rotor 51 spins inside cavity 57 and agitates fluid $F_1$ as explained below. It is important that the shape of shell 55 be cylindrical to ensure even distribution, or conduction, of heat generated in cavity 57 towards the outer surface thereof. Rotor 51 has a plurality of flow-efficient vanes 52, and the diameter of cavity 57 and the size of rotor vanes 52 are predetermined so as to provide only minimal clearance between the inner surface 56 of cavity 57 and the outermost edges of vanes 52 (see FIG. 4) as rotor 51 spins therein. Because of the special design of vanes 52, as will be explained below, no internally fixed vanes, or stators, are required to sufficiently agitate fluid $F_1$ to increase the temperature of fluid $F_1$. Cavity 57 is sealed at both ends of block 50 by end plates 70, 71 (see FIG. 2), which plates may be secured to the ends of outer shell 61 by bolts 27 (see FIG. 1) and gaskets (not shown) or other known techniques. Each end plate 70, 71 contains a center bore 75 through which shaft 74 projects and a pulley 89 and appropriate locking mechanisms 68 are fixedly secured thereon. Each center bore 75 can have a bearing (not shown) as is known in the art to carry journaled shaft 74 and this arrangement provides sealing transfer of movement from motor 12, or other power source, through belt 13 to pulley 89 to shaft 74 and thence to vaned rotor 51.

Outer cylindrical shell 61, also of a predetermined thickness, surrounds inner shell 55, and provides an elongated passageway 65 extending either substantially completely around, or only approximately halfway around, the outer circumference of shell 55 from substantially one end to the other for a purpose to be described later. As can be seen in FIG. 3, shell 61 has four identical supports 66*a, b, c, d* (66*c* not shown) to provide a steady base as block 50 sits inside housing 11, although other suitable means can be employed. An inlet 67*a* and an outlet 67*b* (FIG. 4) are bored through circular projections 68*a*, 68*b*, respectively, in outer shell 61 at predetermined points in the middle of the lower portion of the sides (at about 7 o'clock and 5 o'clock positions, respectively) to allow heat transfer fluid $F_1$ to enter and exit passageway 65, through communication with appropriate connections and pipes 18 (see FIGS. 1 and 2) after travelling about 330° around the outer surface of shell 55. It has been found that this cylindrical arrangement provides maximum heated surface (of shell 55) to allow a second quantity of fluid, fluid $F_2$, traveling through passageway 65, to absorb the most heat in the shortest amount of time. Opening 69 is used to add fluid $F_2$ to passageway 65 and is closed by an appropriate plug (See FIGS. 1 and 2).

In an alternate embodiment, outlet 67*b* may be plugged up and the section of pipe 18 joined thereto connected instead to opening 69 after the appropriate amount of fluid $F_2$ has been added. An expansion tank 25, a pressure gauge 26 and relief valves 28 are fitted, through connection to a section of pipe 18, through end plate 71 to cavity 57, as is known in the HVAC industry.

In the preferred embodiment, the rotor means 51 comprises a shaft 74 having a plurality of vanes 52, spaced equi-distant apart and longitudinally fixed to shaft 74. Shaft 74 is rotatably journalled through the centers of end plates 70, 71 and coupled to motor 12 by belt 13, pulley 89 and locknut 88, or other suitable means known in the art.

FIGS. 6 and 7 show, respectively, isolated perspective views of rotor 51 and 51*a*. FIG. 6 shows that rotor 51 can have eight vanes 52 (52*a*) (as will be further described below) fixedly attached, as by mig-welding, to predetermined and equally-spaced positions on central shaft 74. As shown in FIG. 7, six vanes 52*a* may be used. Each individual vane 52 (52*a*) is stamped of hot rolled, pickled-in-oil, 12 gauge, milled steel sheets by a 100 ton Clausing O.B.I. press, or other similar device.

Each individual vane 52*a* has a comb-like portion stamped out of the rectangular frame so that parallel sides 54*a*, 55*a* are longer than parallel ends 56*a*, 59*a*, and are approximately as long as the inner length of cavity 57. Side 54*a* is mig-welded in a plurality of positions longitudinally along shaft 74*a* and has a plurality of equally-spaced and equally-sized teeth 58*a*, flanked by spaces of substantially the same size, extending approximately ¾ths of the distance to side 55*a*, in the same plane as the rectangular frame, therefrom. As shown in FIG. 6, parallel side member 55 can be canted, or bent, to an angle of approximately 45° (see also FIG. 4) in a clockwise direction.

Figure 8:
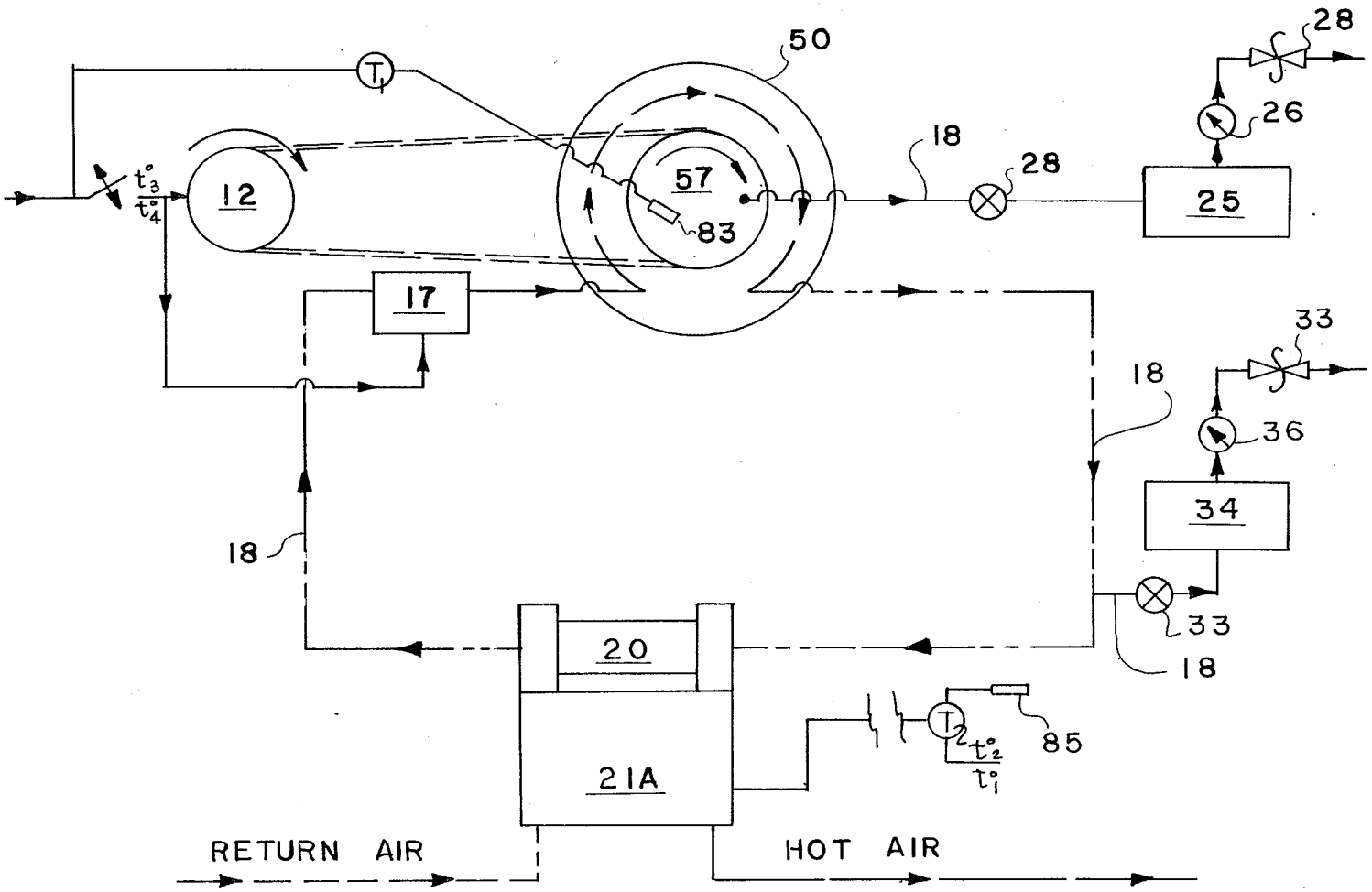
FIG. 8 is a schematic block diagram of the electronic control circuit 80 of FIG. 1 when air is used to transport the heat to a remote location, as in a home (not shown)
Figure 9:
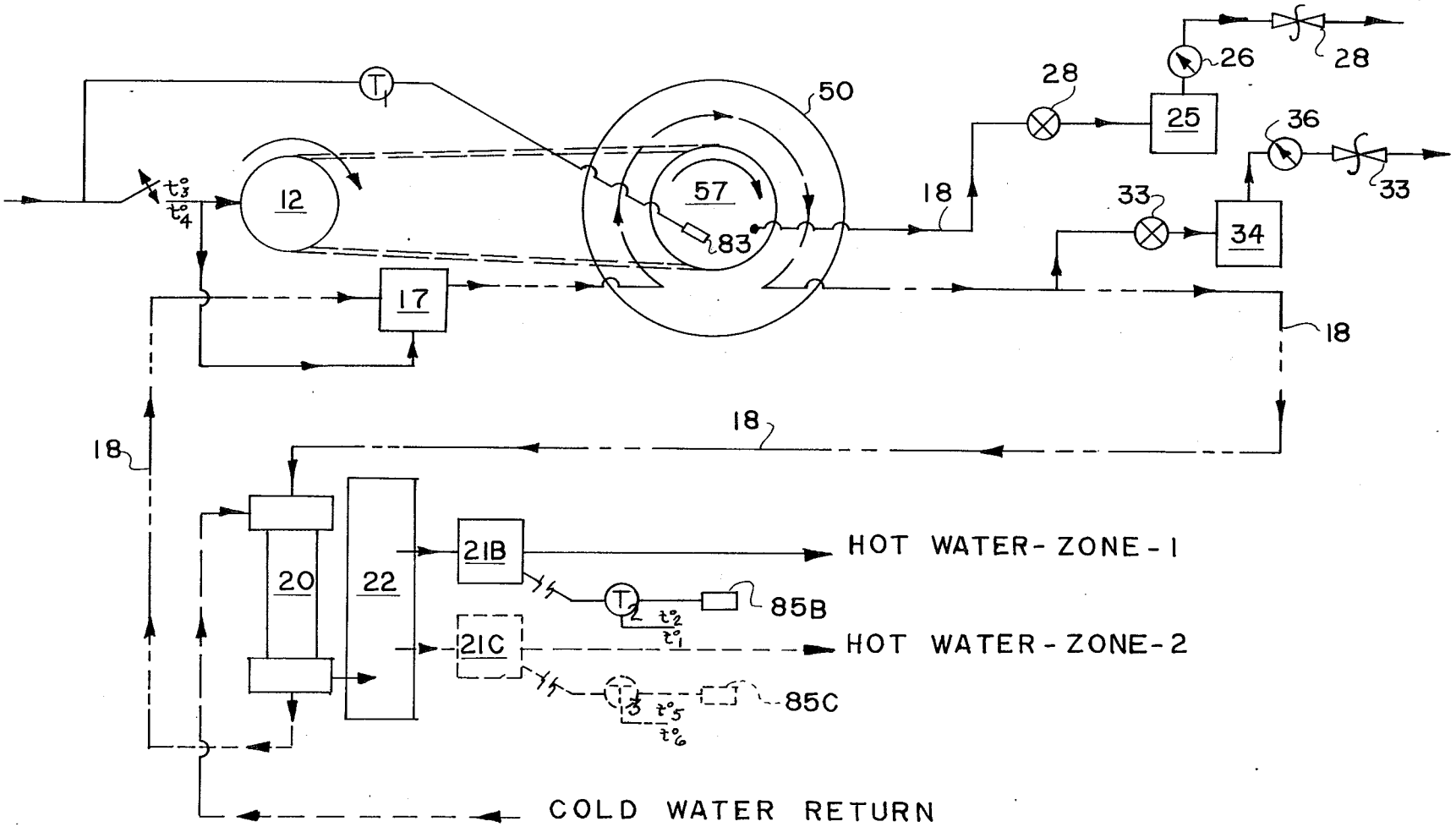
FIG. 9 is a schematic block diagram of the electronic control circuit 80 of FIG. 1 when water is used to transport the heat to a remote location, as in a home (not shown).

As seen in the schematic block diagrams in FIGS. 8 and 9, heat transfer in heat source 10 takes place by all three known heat transfer methods: by conduction—as the heat generated in fluid $F_1$ inside cavity 57 diffuses through the inner cylindrical wall 64 of block 50; by convection—after fluid $F_2$ in passageway 65 absorbs the heat from cylindrical wall 64, the heat is carried from circumferential passageway 65 through insulated pipe 18 to heat exchanger 20; and by radiation—where heat waves radiate from heat exchanger 20 to the space in front of heat distribution means 21A, 21B, or 21C (in phantom).

The heat transfer fluids $F_2$ (inside cavity 57) and $F_1$ (that circulates through circumferential passageway 65) are any compressible, low viscosity, heat-absorbing fluids. This fluid can be either a commercially available, petroleum-based synthetically-made or a synthetically-made, heat transfer fluid as is known in the art. Automobile automatic transmission fluid is one example of such a heat-transfer fluid. When approximately 1 gallon of fluid $F_1$ is used in cavity 57 and vaned rotor 51 (51*a*) is rotated therein at 3600 r.p.m. by coupling to a 5 horsepower motor run at 22 amps on a single phase electrical system, the frictional forces developed between the layers of fluid will convert substantially all of the mechanical energy of motion into heat and raise the temperature of the fluid $F_1$ from room temperature (near 72° F.) to a temperature near 360° F. in less than 5 minutes. It has been found that the pressure inside cavity 57 does not rise above approximately 10 p.s.i. Approximately 11 quarts of heat transfer fluid $F_2$ is circulated, via pumping action of approximately 5 pounds of pressure by circulation pump 17, through passageway 65 and to the pipes (not shown) in heat exchanger 20 and back to pump 17, and absorbs heat from block 50 as it passes therearound. When the alternate embodiment described above is employed, it, has been found that fluid $F_2$ inside the outlet **67*b* side of passageway 65 remains at about 250° to 260° constantly, and fluid $F_2$ exiting through outlet 69** is made hotter yet by mixing with this constantly heated fluid source.

In FIGS. 8 and 9, heated fluid $F_2$ is transported in lines 18 having two dashes and cooler returning fluid $F_2$ is transported in lines 18 having three dashes. The particular type of heat exchanger 20 used in the present invention is the serpentine type, as is known in the industry. Fan 21A can be a conventional 24 inch bladed fan, as a Dayton Industries Blower. Of course, other suitable types of heat exchangers and fans may be used. As shown in FIG. 9, hot water distribution pumps 21B, 21C (in phantom) are used when a hot water system is used. If the pressure in these circulation systems reaches a predetermined limit, pressure relief valves 33, adjacent pump 17, open to allow fluid $F_2$ to expand through a pipe 18 to an expansion tank 34 as is known in the industry. Gauge 36 shows a measure of the pressure in this circulation system. The heat transfer fluid $F_2$ gives up its heat by radiation as it passes through heat exchanger 20 (FIG. 8) as is known in the art. An alternate embodiment (FIG. 9) provides for the transfer of heat by conduction from heat exchanger 20 to water in a hot water tank 22.

As shown in FIGS. 8 and 9, if a demand is made for heat at a remote location, by turning house thermostat 85, the ambient temperature, $t°_1$, is compared to the set temperature, $t°_2$. If heat is required, a signal is sent by a thermo switch to allow power to go to blower 21A or to heat circulation pumps 21B, 21C. An independent thermo switch 83 inside cavity 57 senses the temperature of the fluid $F_1$ inside cavity 57 and when that temperature drops below a predetermined level ($t°_3$) sends a starting signal to the soft start control of motor 12, or other suitable drive means, and to circulation pump 17. The soft start control is comprised of a contactor and soft start module that ramps the torque of motor 12 from 50% to full power in approximately 2 seconds. An alternate embodiment uses a centrifugal clutch, as is known, to transfer power to rotor 51. Motor 12, as coupled through belt 13 causes rotor 51 to spin, thereby forcing fluid $F_1$ against the inside of cavity 57 and generating heat. When the sensor 83 senses that the temperature inside cavity 57 has reached a pre-determined higher level ($t°_4$), it sends a shut-off signal to motor 12 and to pump 17. When the temperature at the remote location reaches the desired point ($t°_2$), control 85A (85B or 85C) sends a shut-off signal to fan 21A or pumps 21B, 21C (FIG. 9). By operating in this manner, source 10 ensures that adequate heat is available to be distributed on demand.

Obviously, many modifications and variations of the present invention are possible in the light of the above teachings, and, it is therefore understood that, within the scope of the disclosed inventive concept, the invention may be practiced otherwise than specifically described.

What we claim is:

1. An apparatus for producing heat comprising:

a. a cylindrically-shaped block having an annular cavity;

b. a rotatable shaft journalled through said block and a first source of heat-transfer fluid contained therein, and having a plurality of vanes of predetermined thickness, length and height fixed thereto at predetermined locations on the outer circumference thereof and wherein said plurality of vanes are fixed to said shaft such that each said vane has at least one edge thereof in parallel relation to the axis of said shaft;

c. a passageway of predetermined depth and width circumferentially extending around substantially all of said block for guiding movement of heat-transfer fluid from a second source past said block to a heat distribution point;

d. circulation means connected to said second source to control movement to fluid therefrom; and e. power control means connected to said shaft.

2. A system for heating the air or water in a home or other structure comprising a. a first cylindrically-shaped section with a first, outer, diameter having an hermetically sealed annular cavity located coaxially therein and containing a first quantity of fluid therein;

b. a rotatable shaft journalled through the center of said section and having at least one vane of predetermined length and height affixed thereto inside said cavity;

c. a second, hollow, cylindrically-shaped section with a second, larger, inner, diameter concentrically surrounding said first section and being hermetically sealed at opposite ends thereof to define a passageway of predetermined depth and width circumferentially extending around the outer surface of substantially all of said first section and containing a second quantity of fluid and input and output pipes connected thereto to form a closed circulatory system with said passageway and a heat distribution point;

d. heat distribution means located at said point for directing the heat from said second quantity of fluid to desired locations in the home;

e. pumping means connected in said circulatory system for moving said second quantity of fluid;

f. power means connected to said shaft for causing rotational movement thereof; and g. control circuitry including temperature sensing means for sensing fluid temperature of said first quantity and said second quantity and providing controlling signals to said power means and said pumping means.

3. A system as in claim 2 wherein said power means is a variable speed motor.

4. A system as in claim 2 wherein said vanes comprise a rectangular frame with a plurality of teeth located, in the same plane, inside said frame.

5. A system as in claim 3 wherein said vanes further comprise a frame with at least one parallel member offset from said plane at a predetermined angle.

6. A heat producing apparatus comprising:

a first, hollow, cylindrical section with a first, external, diameter, being hermetically sealed at opposite ends and containing a first quantity of fluid, and having a coaxially disposed and rotatably journalled rotor shaft therein;

at least one vane to agitate said first quantity of fluid on said rotor shaft;

a second, hollow, cylindrical section with a second, larger, internal diameter being concentrically disposed around said first section, and being hermetically sealed at opposite ends thereof, to define a passageway for a second quantity of fluid adjacent said first section, power control means adjacent said shaft and connected thereto to spin said shaft;

heat distribution means external and adjacent to said second section to distribute heat to a selected environment;

input and output pipes connected into and out of said passageway to carry said second quantity of fluid into and out of said heat distribution means exchanger and back to said passageway; and a pump to provide movement to said second quantity of fluid.

* * * * *

UNITED STATES PATENT AND TRADEMARK OFFICE

CERTIFICATE OF CORRECTION

PATENT NO. : 4,781,151

DATED : November 1, 1988

INVENTOR(S) : George H. Wolpert, Jr. et al.

It is certified that error appears in the above-identified patent and that said Letters Patent is hereby corrected as shown below:

Column 4, line 58, "$F_2$" should read as "$F_1$";

line 62, after "petroleum-based" insert a --,-- (comma); and after "petroleum-based" and before "or", please delete "synthetically-made".

Signed and Sealed this

Twenty-fifth Day of December, 1990

*Attest:*

HARRY F. MANBECK, JR.

*Attesting Officer*

*Commissioner of Patents and Trademarks*